US005154292A

United States Patent [19]

Bartucca et al.

[11] Patent Number: 5,154,292

[45] Date of Patent: Oct. 13, 1992

[54] SPORTS CARD SLEEVE BOX

[76] Inventors: Frank A. Bartucca, 1506 Glencroft Rd.; Ronald S. Dyo, 1508 Glencroft Rd., both of Glendora, Calif. 91740

[21] Appl. No.: 801,342

[22] Filed: Dec. 2, 1991

[51] Int. Cl.[5] ..... B65D 85/48

[52] U.S. Cl. ..... 206/449; 206/39.3; 206/39.5; 206/804; 206/815; 220/4.21; 220/8; 220/306

[58] Field of Search ..... 206/1.5, 38, 39, 39.3, 206/39.5, 39.7, 449, 804, 815; 220/4.21, 8, 306, 326

[56] References Cited

U.S. PATENT DOCUMENTS

| | | | |
|---|---|---|---|
| 965,495 | 7/1910 | Woodruff | 220/8 |
| 1,130,271 | 3/1915 | Hammond | 206/815 |
| 1,916,119 | 6/1933 | Schwartz et al. | 206/815 |
| 2,506,256 | 5/1950 | Waldo | 220/8 |
| 2,652,635 | 9/1953 | Conger | 206/39 |
| 2,997,168 | 8/1961 | Tall | 206/815 |
| 3,464,582 | 9/1969 | Greitzer et al. | 220/306 |
| 3,901,406 | 8/1975 | Kivett | 220/8 |
| 3,927,195 | 12/1975 | Messora | 220/8 |
| 3,984,027 | 10/1976 | Smith | 220/306 |
| 4,346,815 | 8/1982 | Raymor et al. | 220/306 |
| 4,509,656 | 4/1985 | Rosler | 220/8 |
| 4,702,389 | 10/1987 | Bozinovich et al. | 220/306 |

FOREIGN PATENT DOCUMENTS

| | | | |
|---|---|---|---|
| 415169 | 8/1934 | United Kingdom | 206/804 |

*Primary Examiner*—David T. Fidei
*Attorney, Agent, or Firm*—William W. Haefliger

[57] ABSTRACT

A sports card sleeve storage box comprising a receptacle having a bottom wall, upstanding side walls and upstanding end walls; and a cover fitting onto the receptacle, and having a top wall, depending side walls adjacent the respective side walls of the receptacle, and depending end walls adjacent the respective end walls of the receptacle; the receptacle sized to receive and orient a multiplicity of sports card sleeves, in a stack; and first structure proximate upper extents of certain of the receptacle walls and second structure proximate upper extents of certain of the cover walls for releasably interfitting below the cover top wall in response to reception of the receptacle into the cover thereby to releasably lock the cover to the receptacle without interfering with the reception and orientation of the sleeves into the receptacle.

12 Claims, 4 Drawing Sheets

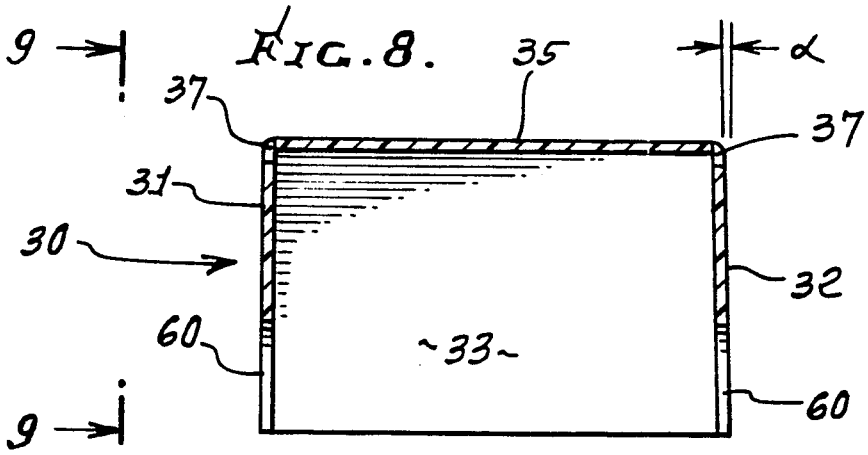
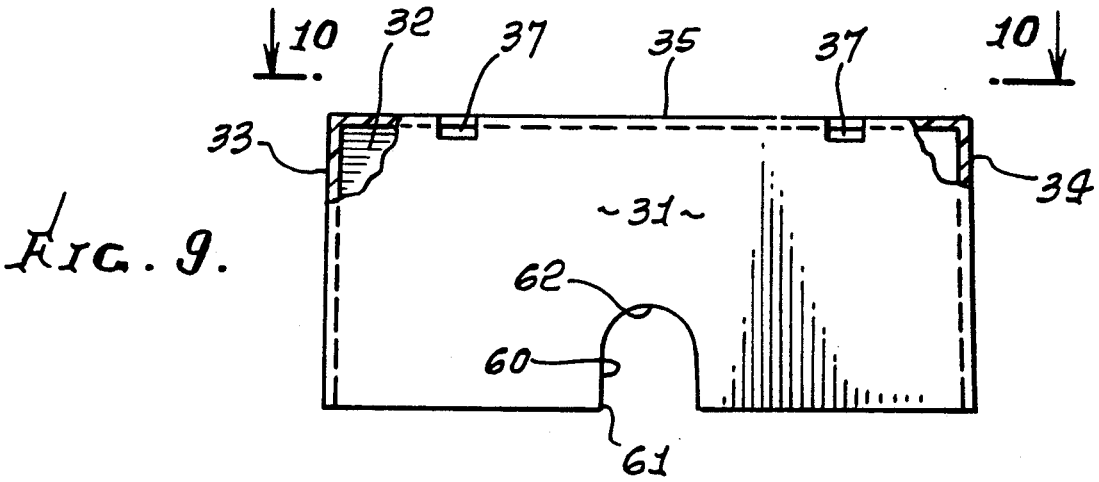
FIG. 9.
FIG. 10.
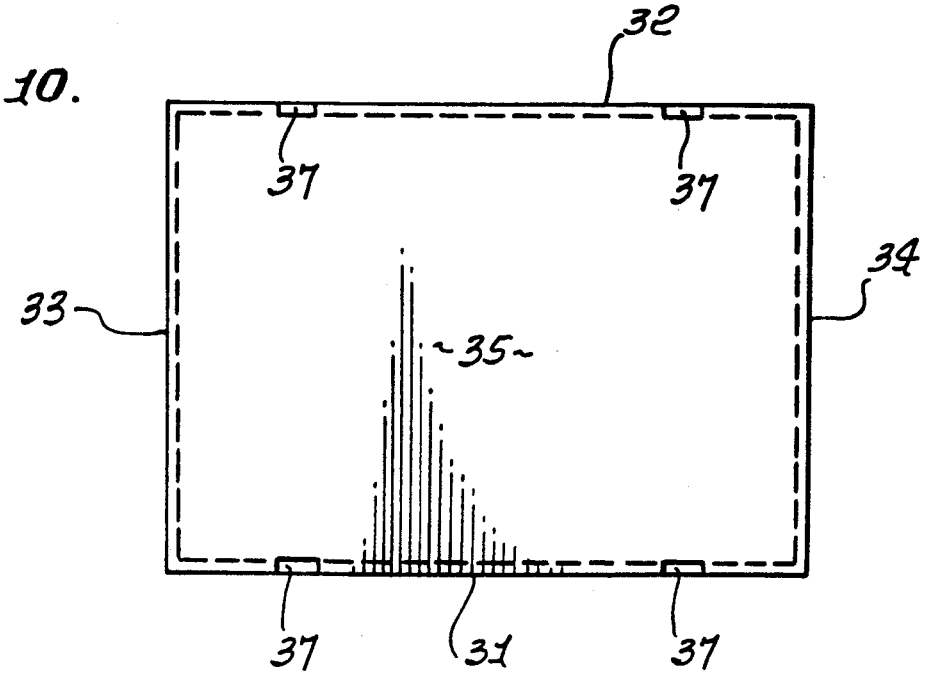

SPORTS CARD SLEEVE BOX

BACKGROUND OF THE INVENTION

This invention relates generally to storage boxes, useful to store sports cards, such as baseball cards; and more particularly, it concerns a highly useful, protective box to contain plastic sleeves for such cars, the box facilitating rapid retrieval of selected sleeves from a stack of such sleeves in the box.

Sports cards, such as baseball cards, have become increasingly valuable over time. Such cards, made of cardboard, are easily damaged, which diminishes their value. Efforts to protect these cards have led to use of thin plastic sleeves into which the cards are received, to be retrieved as required; however, storage of such sleeves has itself become a problem. Typically, the card-containing sleeves were simply placed randomly in trays or envelopes and allowed to slip and slide about, leading to disorganization, especially as the trays were transported, as to card trade sites. There is, therefore, need for simple, effective apparatus to organize and protect sports card carrying plastic sleeves.

SUMMARY OF THE INVENTION

It is a major object to provide a solution to the above-described problems meeting the identified need.

Basically, the present invention meets such need through provision of a sports card sleeve storage box comprising:

a) a receptacle having a bottom wall, upstanding side walls and upstanding end walls, b) and a cover fitting onto the receptacle, and having a top wall, depending side walls adjacent the respective side walls of the receptacle, and depending end walls adjacent the respective end walls of the receptacle, c) the receptacle sized to receive and orient a multiplicity of sports card sleeves, in a stack, d) and first means proximate upper extents of certain of the receptacle walls and second means proximate upper extents of certain of the cover walls for releasably interfitting below the cover top wall in response to reception of the receptacle into the cover thereby to releasably lock the cover to the receptacle without interfering with the reception and orientation of the sleeves into the receptacle.

As will be seen, rapid interfit of the receptacle and cover to facilitate interlock at the end of such interfit is facilitated by imparting upward taper to the certain depending walls of the cover, and downward taper to the certain upstanding walls of the receptacle.

It is another object to provide a box, as referred to, wherein the first means and second means have tongue and groove interfit, and typically such tongue and groove interfit is between planes defined by the inner sides of the tapering receptacle walls and planes defined by the outer sides of the tapering cover walls, such walls of both the receptacle and cover being resiliently flexed.

Further, the first means may advantageously comprise tangs spaced apart along each of the certain receptacle side walls, and the second means may comprise grooves spaced apart along each of the certain cover side walls, the tangs releasably fitting into the grooves with detent action only when the cover is fully closed onto the receptacle. As will appear, there are most advantageously two tangs spaced apart lengthwise at the tops of each of the receptacle side walls, and two openings are space apart lengthwise at he tops of each of the cover side walls, adjacent the cover top wall.

Yet another object is to locate the sports card sleeves in a stack, in the receptacle, the sleeves having edges closely oriented by the receptacle side walls, the stack extending into peripheral proximity to the first and second means for detentingly locking the receptacle and cover. In addition, a through opening may be provided in a cover side wall and extending into proximity to lower edges thereof, for finger reception to pull the cover off the receptacle. Also, a through opening may be provided in an end wall of the receptacle for finger or thumb reception to engage and selectively lift a sleeve or sleeves from the receptacle, the opening extending into proximity to an upper edge of the end wall, the opening in the end wall of the receptacle being protectively enveloped by an end wall of the cover.

Finally, the box walls may consist of relatively stiff, molded plastic material, which is sufficiently transparent to allow visual observation of transparent sleeves in a stack in the box with cards in the sleeves. Ease of opening of the box, and retrieval of the organized cards, are further facilitated.

These and other objects and advantages of the invention, as well as the details of an illustrative embodiment, will be more fully understood from the following specification and drawings, in which:

DRAWING DESCRIPTION

FIG. 8 is a vertical section taken in end view through the box cover;

FIG. 9 is an end elevation taken on lines 9—9 of FIG. 8;

FIG. 10 is a top plan view taken in section on lines 10—10 of FIG. 9;

DETAILED DESCRIPTION

Figure 1:
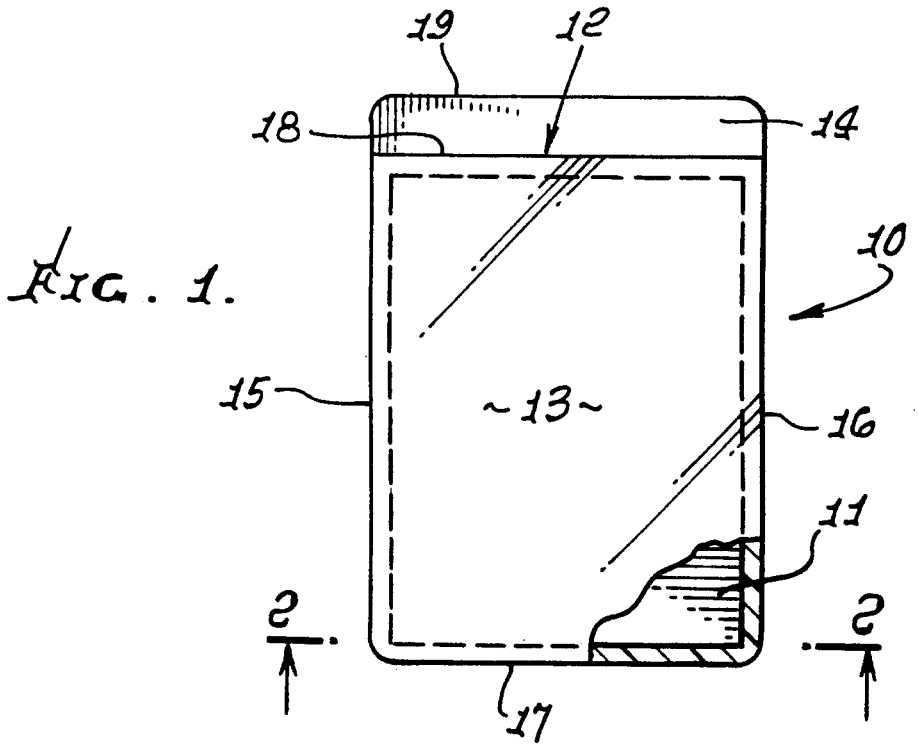
FIG. 1 is a top plan view of a sports card sleeve with a card received therein.
Figure 2:
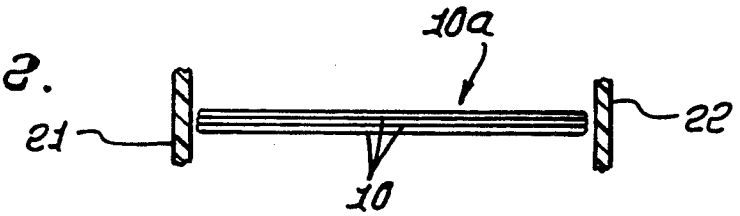
FIG. 2 is a section taken on lines 2—2 of FIG. 1.

In FIG. 1, a thin plastic rectangular sleeve 10, typically transparent, protectively receives a sports card 11, as via a slit at 12. The sleeve top and bottom layers appear at 13 and 14 in FIG. 3; and these are peripherally joined along three edges 15–17 of the sleeve. Edge 18 of the top layer 13, adjacent slit 12, is not joined to the lower layer, and is offset from edge 19 of bottom layer 14. Sleeve dimensions are typically as follows:

length "l" is about $4\frac{1}{2}$ inches width "width" is about 3 inches.

Figure 3:
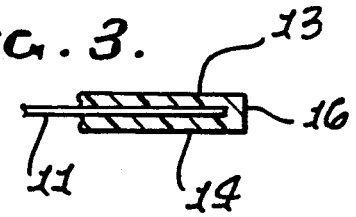
FIG. 3 is an enlarge fragmentary section showing the fit of a sports card in the sleeve.
Figure 4:
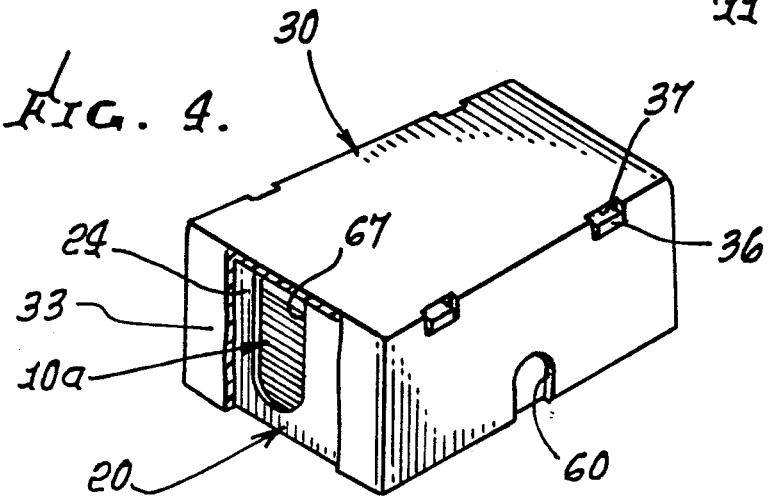
FIG. 4 is a perspective view of a box incorporating the invention, and cut away to show sleeves in the box.
Figure 5:
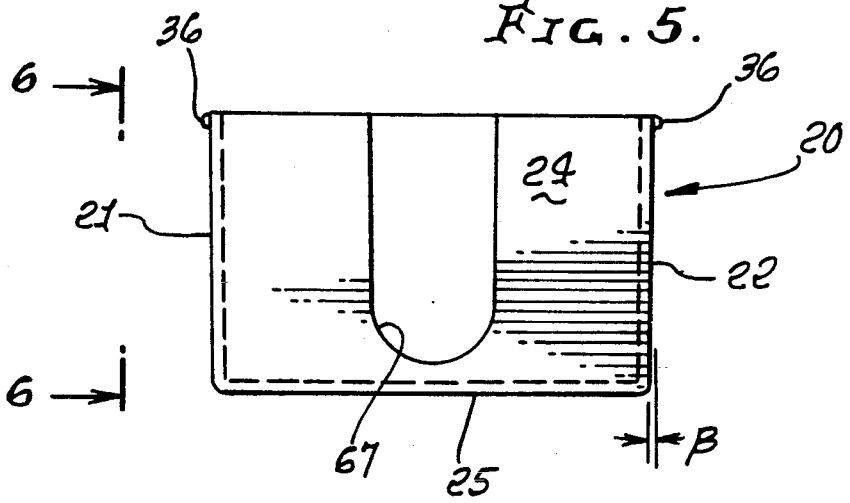
FIG. 5 is an end elevation of a box tray or receptacle for the sleeves.
Figure 6:
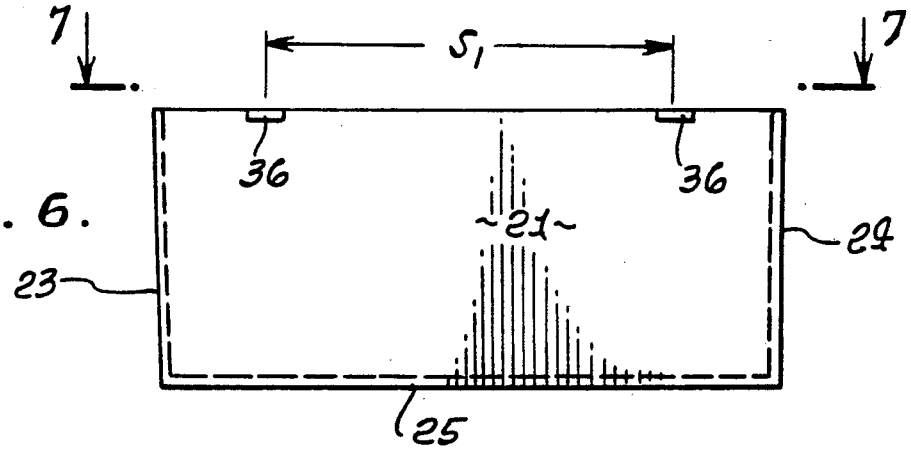
FIG. 6 is a side elevation taken in lines 6—6 of FIG. 5.
Figure 7:
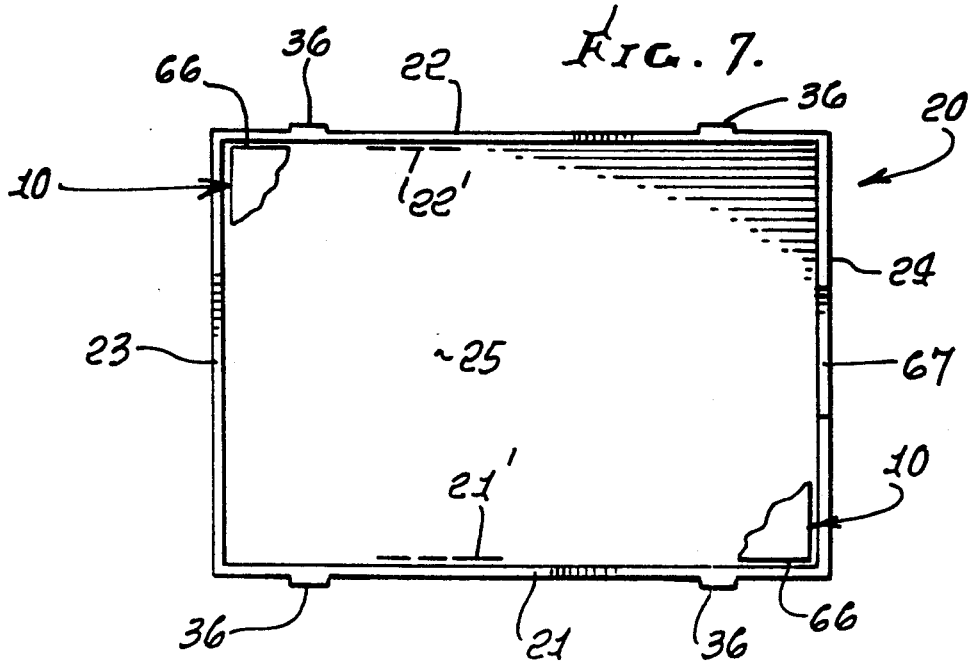
FIG. 7 is a section taken on lines 7—7 of FIG. 6.

A stack 10*a* of such sleeves 10 appears in FIG. 3, between upright side walls 21 and 22 of a receptacle 20, better shown in FIGS. 5–7. A cover 30 fits downwardly closely over the receptacle to protectively confine the stack of sleeves, the cover and receptacle defining box 38, while allowing easy retrieval of sleeves (and sports cards) as needed.

In FIGS. 5–7, the plastic receptacle 20 has upright side walls 21 and 22, upright end walls 23 and 24, and a bottom wall 25. As referred to, the receptacle is sized to closely receive and orient the edges of the sleeves 10 in a stack. The molded plastic cover may consist of polypropylene, for example, and all wall thicknesses are about 0.075 inches.

In FIGS. 8–10, the plastic cover 30 has upright side walls 31 and 32, upright end walls 33 and 34, and a top wall 35. The cover is sized to closely and slidably fit downwardly over the receptacle, and may also consist of polypropylene, with wall thicknesses about 0.075 inches. Both cove and receptacle are typically transparent to the extent that the stack of sleeves can be seen through cover top wall, and receptacle bottom wall (the cover having no bottom wall to register with the receptacle bottom wall and vice versa).

In accordance with an important aspect of the invention, first means is provided proximate upper extents of certain of the receptacle walls, and second means is provided proximate upper extents of certain of the cover walls, for releasably interfitting in detent relation in response to reception of the receptacle into the cover thereby to releasably lock the cover to the receptacle without interfering with the reception and orientation of the sleeves into the receptacle. In this regard, certain depending walls of the cover taper upwardly and certain upstanding walls of the receptacle taper downwardly.

For example, the referenced first means may comprise tow tangs 36 spaced apart lengthwise on and along the tops of the receptacle side walls 21 and 22, as seen in FIGS. 5–7. The two tangs on the top of each side wall are closer to end walls 23 and 24 than they are to each other, and may be spaced apart by about 2.75 inches (see dimension $S_1$.). The tangs project outwardly, as seen in FIG. 5. The referenced second means may comprise two grooves or openings 37 spaced apart lengthwise in and along the tops of each of the cover side walls 31 and 32, just below top wall 35, as seen in FIGS. 8–10. Such openings may project sidewardly through the walls 31 and 23, and may also extend upwardly through wall 35 at its edges, and the grooves are sized and spaced to closely receive the tangs, when the cover is fully fitted downwardly on the receptacle, and as the cover and receptacle side walls yieldably flex relatively away from one another as the cover approaches its downward position on the receptacle. Such flexing occurs as the tangs 36 slidably and interferingly engage the inner sides of cover side walls 21 and 22. In this regard, minimized interference may be achieved by providing slight upward taper of both side walls 31 and 32 of the cover, and/or slight downward taper of both side walls 21 and 22. See the taper angles $\alpha$ and $\beta$ which are about 1°. The tangs are received into the openings with detent action, i.e., side walls spring back, and the tangs are rounded to easily ride out of the openings, when the cover is lifted. The unright end walls 23 and 24 may also have similar slight upward taper, and/or upright end walls 33 and 34 may have slight downward taper to provide smooth local sliding interfit as the cover and receptacles are closed together, whereby end-to-end and side-to-side looseness are minimized. See also tapered upright gap 37 between side walls 21 and 31, and between side walls 22 and 32; and tapered upright gaps 38 between end walls 23 and 33, and between end walls 24 and 34.

A further feature is the provision of through openings 60 in cover opposite side walls 31 and 32, and extending vertically downwardly into proximity at 61 with the lower edges of such walls. Upper curved shoulders 62 at the upper ends of the openings or slots 60 provide finger grips or holds, for pulling the cover upwardly of the receptacle, accompanied by forcible detenting of the tangs out of their openings, as referred to. This is accommodated by yieldable inward flexing of receptacle side walls 21 and 22 to positions indicated by broken lines 21' and 22' in FIG. 7, and finger pressure may be exerted on the walls, through openings 60, to enhance such flexing. In this regard, there is slight clearance 66 between the edges of the sleeves and the side walls 21 and 22, to further accommodate such inward flexing, such clearance increasing in an upward direction due to receptacle side wall taper, which also facilitates side wall inward flexing and tang detenting.

In addition, there is also a vertically elongated through opening 67 in end wall 24 of the receptacle for finger or thumb reception to engage and selectively lift a sleeve or sleeves from the receptacle, the opening extending into proximity to an upper edge of the end wall, the opening 67 in the end wall of the receptacle being protectively enveloped by an end wall 33 of the cover. Thus, after the cover is removed, it is easy to lift one or more sleeves from the receptacle by inserting a finger or thumb through opening 67 and at selected level to lift a selected group of sleeves from the stack, for removal from the receptacle, as for inspection of the cards.

Figure 11:
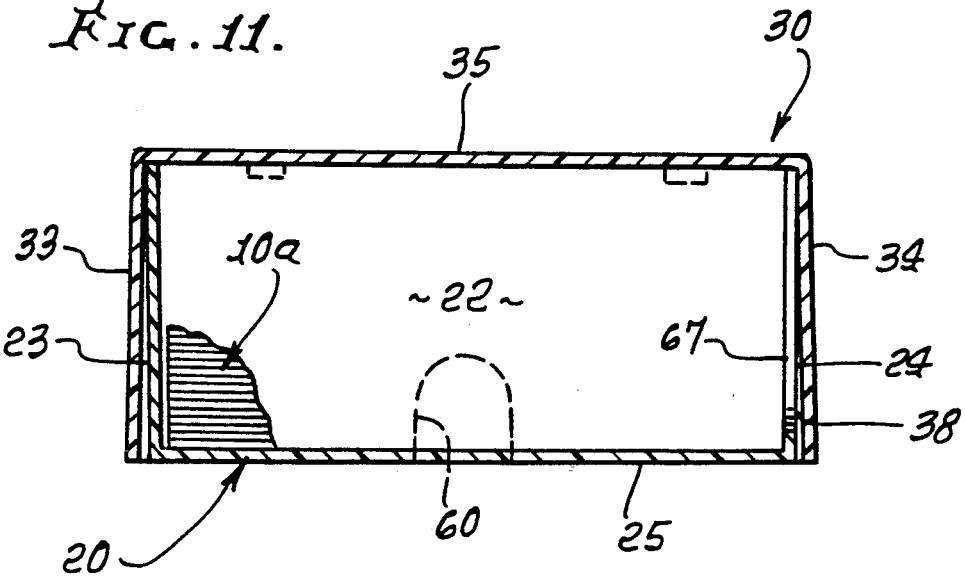
FIG. 11 is a side elevation taken in section through assembled cover and receptacle.
Figure 12:
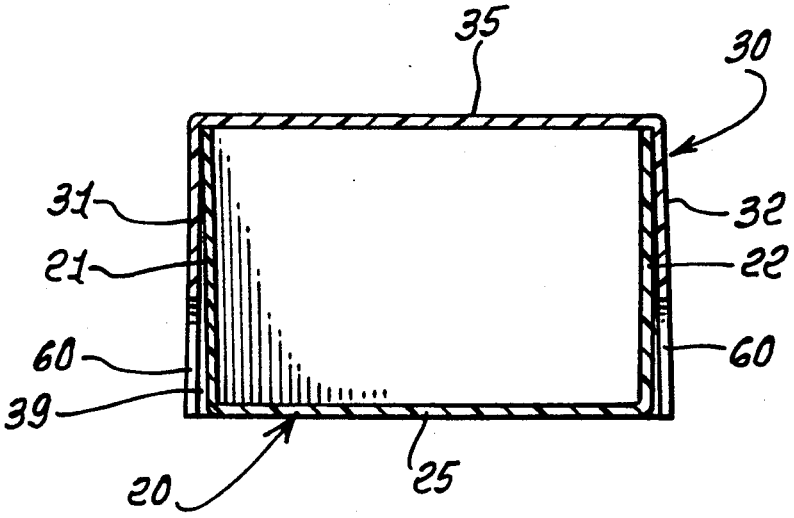
FIG. 12 is an elevation taken in section through assembled cover and receptacle.
Figure 13:
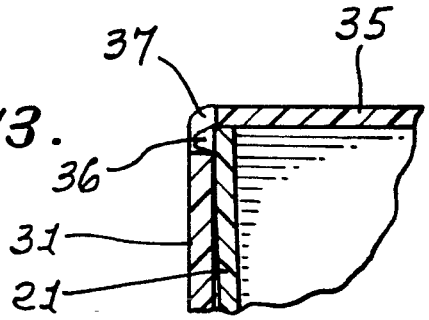
FIG. 13 is an enlarged fragmentary view showing assembled interfit of tongue and groove elements on the receptacle and cover.

FIGS. 11 and 12 show interfit of the tapered walls of the cover and receptacle; and FIG. 13 shows a tang 36 detentingly received outwardly into a groove 37, just below cover top wall 35. Note tapered slots 40 and 41 between walls 21 and 31, and 22 and 32 in FIG. 12; and at 42 and 43 between walls 23 and 33, and 24 and 34.

We claim:

1. In a sports card sleeve storage box, the combination comprising a) a receptacle having a bottom wall, upstanding side walls and upstanding end walls, b) and a cover fitting onto the receptacle, and having a top wall, depending side wall adjacent the respective side walls of the receptacle, and depending end walls adjacent the respective end walls of the receptacle, c) the receptacle sized to receive and orient a multiplicity of sports card sleeves, in a stack, d) and first means proximate upper extents of certain of said receptacle walls and second means proximate upper extents of certain of said cover walls for releasably interfitting below the cover top wall in response to reception of the receptacle into the cover thereby to releasably lock the cover to the receptacle without interfering with the reception and orientation of the sleeves into the receptacle, e) said first means comprising two tangs spaced apart lengthwise along each of said receptacle side walls and at the tops thereof, and said second means comprising two grooves spaced apart lengthwise along each of said cover side walls and at the tops thereof, said tangs releasably fitting into said grooves with detent action only when said cover is fully closed onto said receptacle, f) and including a through opening in a cover side wall and extending into proximity to lower edges thereof, for finger reception to pull the cover off the receptacle, said through opening extending vertically towards an upper portion of said cover side wall located between and spaced from said two grooves at the top of said cover side wall.

2. The combination of claim 1 wherein said certain depending walls of the cover taper upwardly and said certain upstanding walls of the receptacle taper downwardly.

3. The combination of claim 1 wherein said first means and second means have tongue and groove interfit between planes defined by the inner sides of said certain receptacle walls and planes defined by the outer sides of said certain cover walls.

4. The combination of claim 2 wherein said first means and second means have tongue and groove interfit between planes defined by the inner sides of said certain receptacle walls and planes defined by the outer sides of said certain cover walls, and said certain walls of both the receptacle and cover being resiliently flexed.

5. The combination of claim 1 wherein said grooves are openings in said side walls confined to upright planes defined by said side walls.

6. The combination of claim 1 including said sports card sleeves in a stack, in the receptacle, the sleeves having edges closely oriented by the receptacle side walls, the stack extending into peripheral proximity to said first and second means.

7. The combination of claim 6 wherein said sleeves consist of flexible plastic material, there being sports cards protectively received into the sleeves.

8. The combination of claim 1 including a through opening in an end wall of the receptacle, for finger or thumb reception to engage and selectively lift a sleeve or sleeves from the receptacle, said opening extending into proximity to an upper edge of said end wall, said opening in said end wall of the receptacle being enveloped by an end wall of the cover.

9. The combination of claim 1 wherein the cover and receptacle both consist of thin walled molded plastic material, the main extents of the receptacle side walls being resiliently flexible relatively toward one another to limited extents allowing detenting of the tangs into the grooves.

10. The combination of claim 9 in which both end walls of the cover taper relatively upwardly, and both side walls of the cover also taper relatively upwardly.

11. The combination of claim 10 in which both end walls of the receptacle taper relatively downwardly, and both side walls of the receptacle taper relatively downwardly, whereby there is upwardly tapering space formed between each cover end wall and its associated receptacle end wall, and also between each cover side wall and its associated receptacle side wall.

12. The combination of claim 7 wherein said sleeves have lengths of about 4½ inches and width of about 3 inches, the sleeve edges fitting the receptacle side walls more loosely in the upper interior of the receptacle than in the lower interior of the receptacle.

* * * * *